US008707945B2

(12) United States Patent
Hasslberger et al.

(10) Patent No.: US 8,707,945 B2
(45) Date of Patent: Apr. 29, 2014

(54) MULTIPLE OVEN

(75) Inventors: Robert Hasslberger, Ruhpolding (DE); Johann Hofmann, Traunwalchen (DE); Christian Meisinger, Feichten a.d. Alz (DE); Jörg Rosenbauer, Nuβdorf (DE); Jürgen Schuchhardt, Elmshorn (DE); Nesrin Schuchhardt, legal representative, Elmshorn (DE); Bünyamin Schuchhardt, legal representative, Elmshorn (DE); Marvin Schuchhardt, legal representative, Elmshorn (DE); Markus Theine, Freilassing (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1286 days.

(21) Appl. No.: 12/079,289

(22) Filed: Mar. 26, 2008

(65) Prior Publication Data

US 2009/0183723 A1 Jul. 23, 2009

(30) Foreign Application Priority Data

Mar. 29, 2007 (DE) ..... 10 2007 015 273

(51) Int. Cl.
*F24C 15/32* (2006.01)

(52) U.S. Cl.
USPC ..... 126/21 A; 126/273 A

(58) Field of Classification Search
USPC ..... 126/198, 21 A, 21 R, 273 A, 273 R
See application file for complete search history.

(56) References Cited

U.S. PATENT DOCUMENTS

| | | | | | |
|---|---|---|---|---|---|
| 4,354,084 | A * | 10/1982 | Husslein et al. | ..... | 219/757 |
| 4,375,213 | A * | 3/1983 | Kemp et al. | ..... | 126/21 A |
| 4,598,689 | A * | 7/1986 | Eke | ..... | 126/21 A |
| 4,796,600 | A * | 1/1989 | Hurley et al. | ..... | 126/273 A |
| 5,738,081 | A * | 4/1998 | Puricelli | ..... | 126/21 A |
| 5,918,589 | A * | 7/1999 | Valle et al. | ..... | 126/193 |
| 6,913,012 | B2 * | 7/2005 | Divett et al. | ..... | 126/21 A |
| 6,967,310 | B2 * | 11/2005 | Austin et al. | ..... | 219/408 |
| 8,006,687 | B2 * | 8/2011 | Watkins et al. | ..... | 126/198 |
| 8,141,549 | B2 * | 3/2012 | Armstrong et al. | ..... | 126/198 |
| 2008/0184985 | A1 * | 8/2008 | Hasslberger et al. | ..... | 126/21 R |
| 2009/0050130 | A1 * | 2/2009 | Kim et al. | ..... | 126/21 A |
| 2010/0139640 | A1 * | 6/2010 | Watkins | ..... | 126/21 A |

* cited by examiner

*Primary Examiner* — John K Fristoe, Jr.
*Assistant Examiner* — R. K. Arundale
(74) *Attorney, Agent, or Firm* — James E. Howard; Andre Pallapies

(57) ABSTRACT

A multiple oven, especially a double oven, with at least one lower oven and an upper oven arranged above it, features an upper fan for sucking in air over a surface of the upper oven, which features an upper vapor outlet, and also a lower fan for sucking in air over a surface of the lower oven, which features a lower vapor outlet. The multiple oven further features at least one vapor suction duct which is present for directing vapor exiting from the vapor outlet to one of the associated fans.

18 Claims, 1 Drawing Sheet

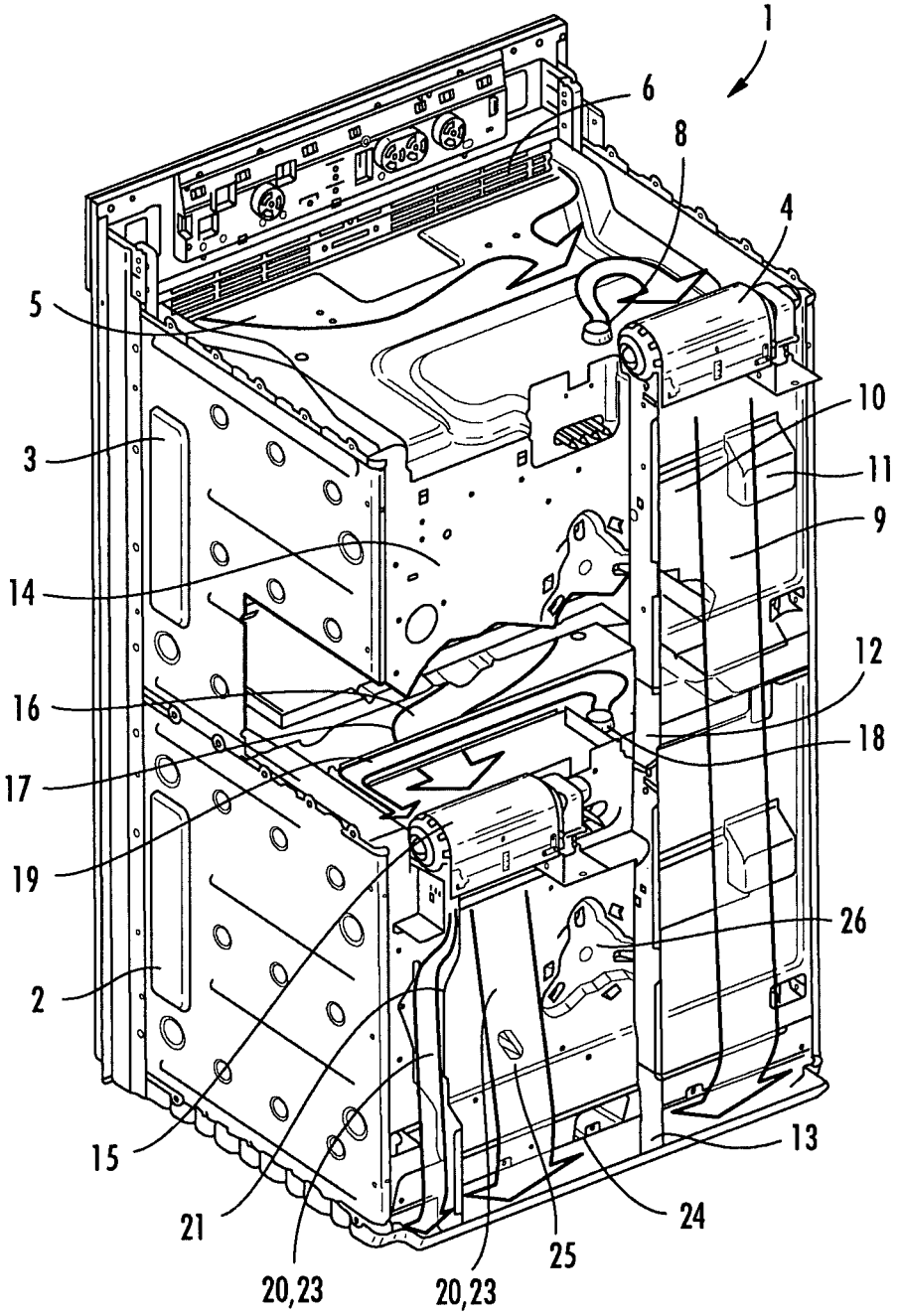
1
6
8
4
5
10
3
11
9
14
12
16
18
17
19
26
2
15
13
21
24
25
20,23
20,23

MULTIPLE OVEN

BACKGROUND OF THE INVENTION

Double ovens, comprising ovens or oven cavities arranged one above the other are known, in which each of the ovens features a fan for sucking in air over its upper side, with a vapor outlet being inserted into the upper side in each case. Typically fresh air is sucked in from the front over the upper side to a fan mounted at the rear, and then from there as exhaust air containing vapor along the rear of the double oven in a floor area and onwards through the floor area to a front-side oven exhaust air opening.

Since the fans occupy a comparatively large volume, they are arranged (when viewed from the rear) offset to the side, so that the lower fan does not reduce the flow cross section of an exhaust air duct of an upper fan too much. The then likewise offset exhaust air ducts of upper fan and lower fan merge back into each other in the floor area. The fact that the fans are offset to the side means that the vapor outlets must also be offset accordingly, since otherwise the distance between at least one of the fans and the assigned vapor outlet is too large for a effective extraction of the vapor. The side offset of the vapor outlets in its turn entails an increased constructional outlay when designing the upper side of the individual ovens.

In order to create sufficient space at the rear side of the lower oven for sensitive components which are not to come into contact with air containing vapor, an attempt has been made with a few known double ovens to divert air containing vapor away from air containing no vapor. The Venturi principle is used for this purpose for example. However with known solutions the explicit separation of air containing vapor from air containing no vapor has to date only been inadequately implemented using solutions which are simple in their construction.

BRIEF SUMMARY OF THE INVENTION

The object of the present invention is thus to create an option for simplified embodiment of a ventilation area of a multiple oven, especially of a double oven. Advantageously an option is to be created for constructively-simple separation of exhaust air containing vapor and exhaust air not containing vapor and/or for a simplification of the construction of the individual devices.

To this end the multiple oven, especially a double oven, with at least one lower oven and an upper oven arranged above it, features an upper fan for sucking in air over a surface of the upper oven, which in its turn features an upper vapor outlet, and also a lower fan for sucking in air over a surface of the lower oven, which features a lower vapor outlet. The multiple oven further features at least one vapor suction duct for directing vapor exiting from one of the vapor outlets to one of the associated fans. The vapor suction duct makes it possible to decouple the position of fan and associated vapor outlet and thus to obtain a simplification of the construction of the individual devices as such. The vapor suction duct also allows air containing vapor to be separated from air not containing vapor en route to the fan in a constructively simple and effective manner.

It is advantageous for the constructively simple and low-cost structure of the individual devices for both vapor outlets to be arranged on the same side of the respective surface (especially on the left or the right hand side of the upper side of the oven), and for the fans to be offset to the side in relation to each other. The vapor suction duct can then be present as a ventilation bridge which is configured to direct vapor sideways to the associated fan.

It is also advantageous for the fan associated with the vapor suction duct (which is connected in terms of flow by the vapor suction duct to the vapor outlet) to be embodied so that air containing vapor sucked into a part area of the fan assigned to the vapor suction duct and air not containing vapor sucked into another part area of the fan are not mixed air in the fan. To this end it is especially advantageous for a crossflow fan to be used as the fan, since this can keep the incoming air flows separated without further separation devices.

It is further advantageous for the fan associated with the vapor suction duct to feature an exhaust air duct which is subdivided into a subduct for air containing no vapor and a subduct for air containing vapor. The sensitive components which are not to be brought into contact with air containing vapor, such as lines, motors and so forth, can be accommodated in the subduct for air containing no vapor.

Also advantageous is a multiple oven in which the upper fan and the lower fan are connected on the output side to respective exhaust air ducts, which extend—especially in parallel—downwards to a floor area of the double oven, especially along a rear side of the double oven.

It is also advantageous for the vapor outlets to be arranged on an upper side of the respective oven, especially if the upper side of the respective oven essentially has an identical basic configuration. This applies especially to an identical position of the respective vapor outlet.

It is advantageous, for effective separation of the vapor from a fresh air area, for the vapor suction duct to cover the associated vapor outlet. Advantageously the vapor suction duct also encloses the associated vapor outlet to the side. Advantageously the vapor suction duct can have upstream air inlet openings.

It is frequently advantageous and sufficient for only one of the fans to be assigned a vapor suction duct, which saves construction costs.

BRIEF DESCRIPTION OF THE DRAWINGS

FIG. 1 is a rear perspective view of a double oven in accordance with an exemplary embodiment of the present invention.

DETAILED DESCRIPTION OF AN EXEMPLARY EMBODIMENT OF THE PRESENT INVENTION

A double oven 1, which is shown without the built-in housing, features a lower oven 2 and an upper oven 3 arranged above it. At a rear edge area of the upper oven 3 an upper fan 4 in the form of a crossflow fan is arranged so as to enable it suck in fresh air 5, as indicated by the arrow shape, through a front ventilation grid 6 via an upper side [7] of the upper oven 3. Incorporated into the upper side [7] is an upper vapor outlet 8 through which vapor can be extracted from the oven space (not shown). Vapor exiting from the vapor outlet 8 is likewise sucked in by the upper fan 4, as indicated by the associated arrow. So that the vapor is completely sucked in where possible, the vapor outlet 8 is provided in the lower right-hand area of the upper side [7] of the upper oven 3, and the upper fan 4 is located for this purpose at a short distance from the edge area lying immediately behind it. From the upper fan 4 mixed air containing vapor is taken out through a first exhaust duct 9 via the rear side of the upper oven 3 and of the lower oven 2 downwards to an area above a base plate (no reference symbol) is directed from there through a void (no reference symbol) forwards. The exhaust channel 9 essentially runs in straight line below the upper crossflow fan 4. The exhaust channel 9 and the upper crossflow fan 4 are arranged here on the right-hand side of the rear side when viewed from behind. Lines or lamp connections arranged in the right-hand side exhaust air duct 9 are shielded by means of additional covers, such as a cable cover 10 and a cover for a lamp connection 11. A shielding from the rest of the rear wall is established by a dividing wall 12 comprising multiple segments if necessary, which is delimited downwards by an end 13 at the void. An unventilated area 14 is thus created on the rear side of the upper oven 4 to the left next to the exhaust air area of the exhaust duct 9 with the air containing the vapor, on which the components for the upper oven module or the upper oven 3 can be arranged, such as a bottom heat connection, an air circulation motor, a rotary spit motor, a ring heating element connection and so forth for example.

A lower fan 15 in the form of a crossflow fan is arranged at a left lower edge area of the lower oven 2 accommodated so as enable it to suck in fresh air 16, as indicated in the form of arrows, through a front-side ventilation grid (not shown) via an upper side 17 of the lower oven 2. To improve the presentation the upper oven 3 is shown in a cut-away view. Incorporated into the upper side 17 of the lower oven 2 is a lower vapor outlet 18, through which vapor can be discharged from the lower oven cavity (not shown). The lower vapor outlet 18 is arranged in the right-hand area of the upper side 17 of the lower oven 2 similar to the upper vapor outlet 8 and thus offset sideways from the lower fan 15. The air containing vapor is sucked through a vapor suction duct in the form of a ventilation bridge 19 on the (seen from behind) left-hand device side of the lower fan 15 and directed from a part area of the lower crossflow fan 15 (on the left here) through a second exhaust air duct 20 downwards to an area above the base plate. The ventilation bridge 19 surrounds the lower vapor outlet 18 on all sides; one upper side of the ventilation bridge 19 is not shown in the drawing here merely to improve presentation. Simultaneously fresh air separated from the vapor is sucked in by the lower fan 15. The lower crossflow fan 15 is embodied so that it mixes the vapor sucked into the part area of the fan and the fresh air sucked into the other part area of the fan. Accordingly the second exhaust air duct 20 is subdivided by means of a dividing wall 21 in a subduct 22 for fresh air and a narrow subduct 23 for air containing vapor. The second exhaust air duct 20 ends in the floor area of the double oven 1, all exhaust air flows are merged here and discharged to the front of the device. Sensitive components such as a bottom heat connection, an air circulation motor, a spit motor, a ring heating element connection and so forth can be accommodated in the subduct 22 for the fresh air, as in the unventilated area 14 of the upper oven 3, a facility which is provided here by a terminal 24 for a bottom heater, a terminal 25 for a ring heating element and a mount 26 for an air circulation motor.

The ventilation bridge 19 enables the effort in constructing the double oven to be reduced, since firstly the upper sides 7, 17 of the respective ovens 2, 3 can have an essentially identical basic form (regardless of any inclusion of additional components or subsequent inclusion of small changes such as an inclusion of holes etc.), especially in relation to the embodiment of the vapor outlet, and only the ventilation bridge 19, as a comparatively simple and easy-to-produce component, needs to be put on, and secondly by a simple and effective separation of fresh air and air containing vapor being made possible, which also makes it possible to dispense with the need to protect components in the area where there is no air containing vapor.

The invention is of course not restricted to the exemplary embodiment shown. Thus the upper fan 4 can also be assigned a vapor suction duct, which essentially routes vapor entirely from the upper vapor outlet to the upper fan, whereby with simultaneous provision of a separation of air containing vapor and air not containing vapor in and behind the upper fan—by using a crossflow fan and a divided exhaust air channel for example—not only an unventilated area, but also an air-cooled area of comparatively higher air flow can be created for cooling down components at the rear wall of the double oven. In an alternate embodiment the lower fan can be embodied similar to the upper fan in the figure shown, whereby, although two separate areas of exhaust air containing vapor and air not containing vapor are no longer created, at least an essentially uniform embodiment of the oven cavities can be achieved. In a further alternate embodiment the upper fan separates the exhaust air into an air stream containing vapor and a stream not containing vapor, and the lower fan does not. The invention is also not restricted to the position of the fan and exhaust ducts depicted; thus for example the upper and the lower fan and the vapor outlets can be arranged turned to the side, not running in a straight line or can run or be mounted at least partly on a side wall of the double oven. In addition the invention is not restricted to the use of just two ovens but can include more than two ovens. Furthermore the invention is not restricted to the use of ovens but also includes combinations of an oven with other domestic appliances to be air-cooled.

The invention claimed is:

1. A multiple oven system, comprising:

a lower oven with a first vapor outlet in an upper exterior surface of the lower oven;

an upper oven located vertically above the lower oven, the upper oven including a second vapor outlet in an upper exterior surface of the upper oven;

an upper fan for sucking in air over a surface of the upper oven;

a lower fan for sucking in air over a surface of the lower oven;

a first ventilation bridge positioned on one of a portion of the upper exterior surface of the lower oven and a portion of the upper exterior surface of the upper oven, the first ventilation bridge directing vapor from one of the first vapor outlet and the second vapor outlet to a corresponding one of the upper fan and the lower fan; and a first exhaust duct extending from the upper fan to a floor area of the system, the first exhaust duct extending along a rear side of the upper oven and a rear side of the lower oven, wherein the first vapor outlet and the second vapor outlet are vertically aligned.

2. The system of claim 1, further comprising a second ventilation bridge that directs vapor from the other of the first vapor outlet and the second vapor outlet to a corresponding one of the upper fan and the lower fan.

3. The system of claim 2, wherein the first ventilation bridge and the second ventilation bridge are different.

4. The system of claim 3, wherein the lower fan is offset horizontally relative to the upper fan.

5. The system of claim 4, further comprising an exhaust duct having a vapor-free subduct and a vapor subduct.

6. The system of claim 5, wherein the first ventilation bridge directs vapor along a first path, and the second ventilation bridge directs vapor along a path that is shaped differently from the first path.

7. The system of claim 3, wherein the first ventilation bridge directs vapor along a first path, and the second ventilation bridge directs vapor along a path that is shaped differently from the first path.

8. The system of claim 1, wherein the lower fan is offset horizontally relative to the upper fan.

9. The system of claim 1, wherein the first ventilation bridge diverts the vapor horizontally.

10. The system of 1, wherein the corresponding one of the upper fan and the lower fan maintains a separation between the vapor from the first ventilation bridge and the air being sucked in over a surface of the respective oven.

11. The system of claim 1, wherein one of the upper fan and the lower fan is a crossflow fan.

12. The system of claim 1, further comprising an exhaust duct having a vapor-free subduct and a vapor subduct.

13. The system of claim 1, further comprising a second exhaust duct extending from the lower fan to the floor area of the system.

14. The system of claim 13, wherein the second exhaust duct extends along the rear side of the lower oven.

15. The system of claim 14, wherein the second exhaust duct is offset horizontally relative to the first exhaust duct.

16. The system of claim 1, wherein the first vapor outlet and the second vapor outlet are identical.

17. The system of claim 16, wherein the first ventilation bridge diverts the vapor horizontally.

18. The system of claim 1, wherein the first ventilation bridge substantially covers the one of the first vapor outlet and the second vapor outlet.

* * * * *